US010041723B2

(12) United States Patent
Lee et al.

(10) Patent No.: US 10,041,723 B2
(45) Date of Patent: Aug. 7, 2018

(54) REFRIGERATOR

(71) Applicant: SAMSUNG ELECTRONICS CO., LTD., Suwon-si, Gyeonggi-do (KR)

(72) Inventors: Tae Youl Lee, Suwon-si (KR); Ji Hoo Kim, Seocheon-gun (KR); Bok Hyun Jang, Suwon-si (KR); In-Sung Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/475,525

(22) Filed: Mar. 31, 2017

(65) Prior Publication Data

US 2017/0343274 A1 Nov. 30, 2017

(30) Foreign Application Priority Data

May 31, 2016 (KR) ..... 10-2016-0067421

(51) Int. Cl.

| | |
|---|---|
| ***F25D 23/04*** | (2006.01) |
| ***F25D 11/00*** | (2006.01) |
| ***F25D 23/06*** | (2006.01) |
| ***F25D 25/00*** | (2006.01) |

(52) U.S. Cl.

CPC ..... *F25D 23/04* (2013.01); *F25D 11/00* (2013.01); *F25D 23/069* (2013.01); *F25D 25/005* (2013.01)

(58) Field of Classification Search

CPC ..... F25D 23/04; F25D 23/069; F25D 23/028; F25D 25/005; F25D 2331/801; F25D 2331/809; F25C 5/182; A47B 88/969; A47B 88/975; A47B 88/988; A47B 88/994; A47B 2088/976

See application file for complete search history.

(56) References Cited

U.S. PATENT DOCUMENTS

| | | | | |
|---|---|---|---|---|
| 3,893,739 A * | 7/1975 | Bernard | ..... | A47B 57/585 211/184 |
| 5,358,128 A * | 10/1994 | Belokin | ..... | A47B 73/008 211/75 |
| 6,742,855 B2 * | 6/2004 | Whitaker | ..... | F25D 23/04 312/321.5 |
| 7,472,974 B2 * | 1/2009 | Czach | ..... | F25D 23/04 312/321.5 |
| 8,657,132 B2 * | 2/2014 | Benz | ..... | A47B 57/586 211/184 |

(Continued)

FOREIGN PATENT DOCUMENTS

| | | | | |
|---|---|---|---|---|
| DE | 9302215 U1 * | 5/1993 | ..... | A47B 57/583 |
| DE | 4304503 A1 * | 8/1994 | ..... | F25D 23/04 |

(Continued)

*Primary Examiner* — Andrew Mark Roersma

(74) *Attorney, Agent, or Firm* — Staas & Halsey LLP

(57) ABSTRACT

The refrigerator has a main body, a storage space in the main body, a storage container located in the main body, and a divider unit mounted in the storage container. The divider unit divides the unit body and storage space disposed in the storage container At least one divider protruding from the unit body, and a holder protruding from the unit body and provided to hang the stored object. The divider unit improves the efficiency of the storage space and can store various types of storage.

19 Claims, 17 Drawing Sheets

(56) References Cited

U.S. PATENT DOCUMENTS

| | | | | |
|---|---|---|---|---|
| 8,864,252 | B1 * | 10/2014 | Rodriguez Cobas | F25D 23/04 312/321.5 |
| 2013/0119844 | A1 * | 5/2013 | Seo | F25D 23/04 312/404 |
| 2015/0192353 | A1 * | 7/2015 | Lee | F25D 23/028 312/325 |

FOREIGN PATENT DOCUMENTS

| | | | | |
|---|---|---|---|---|
| DE | 10257649 | A1 * | 6/2004 | A47B 73/008 |
| DE | 102012105757 | A1 * | 1/2013 | A47B 73/002 |
| EP | 2666388 | A1 * | 11/2013 | F25D 23/04 |
| FR | 2500605 | A1 * | 8/1982 | F25D 23/04 |
| JP | 5-141841 | | 6/1993 | |
| JP | 3208475 | B2 * | 9/2001 | F25D 25/00 |
| JP | 2012026639 | A * | 2/2012 | F25D 23/04 |
| KR | 2003-0082643 | | 10/2003 | |
| KR | 10-2005-0027514 | | 3/2005 | |
| KR | 10-2007-0103790 | | 10/2007 | |
| KR | 10-2011-0079934 | | 7/2011 | |
| KR | 10-2015-0073540 | | 7/2015 | |
| KR | 20150082050 | A * | 7/2015 | |
| WO | WO-2012019892 | A2 * | 2/2012 | F25D 23/04 |
| WO | WO-2013098022 | A1 * | 7/2013 | F25D 23/04 |
| WO | WO-2016134987 | A1 * | 9/2016 | F25D 23/04 |

* cited by examiner

REFRIGERATOR

CROSS-REFERENCE TO RELATED APPLICATIONS

This application claims the priority benefit of Korean Patent Application No. 10-2016-0067421, filed on May 31, 2016, in the Korean Intellectual Property Office, the disclosure of which is incorporated herein by reference in its entirety.

BACKGROUND

1. Field

The present invention relates to a refrigerator, and more particularly, to a refrigerator capable of realizing an efficient storage space.

2. Description of the Related Art

Generally, a refrigerator lowers a temperature therein for freezing food or storing food under refrigeration by discharging cooling air generated by a refrigeration cycle performed by a compressor, a condenser, an expansion valve, an evaporator, and the like.

Generally, a refrigerator is a household appliance that can store food freshly by having a storage room for storing food and a cold supply device for supplying cold air to the storage room.

The inside of the refrigerator can store various kinds of objects, and its size and shape also vary. It is impossible to divide the internal space for various sizes and shapes because the internal space is constant.

Therefore, there is a need for a structure for effectively dividing an internal space of a predetermined size and for storing objects having various shapes.

SUMMARY

Additional aspects and/or advantages will be set forth in part in the description which follows and, in part, will be apparent from the description, or may be learned by practice of the invention.

Therefor, it is an aspect of the present invention provides a refrigerator for storing various kinds of storage material.

It is another aspect of the present invention provides a refrigerator capable of variably partitioning a storage space.

It is another aspect of the present invention provides a refrigerator which improves the accessibility.

In accordance with one aspect of the disclosure, a refrigerator may include a main body, a storage container having a storage space therein, the storage container being located inside the main body and a divider unit mounted on the storage container, wherein the divider unit may includes a unit body disposed in the storage container, at least one divider protruding from the unit body to partition the storage space and a holder protruding from the unit body and adapted to hang a stored product.

The storage container is rotatably provided with respect to the main body, and the divider unit is provided to rotate together with the storage container.

The holder includes a plurality of holders arranged to be spaced apart from each other in the unit body.

At least one surface of the holder is curved.

The at least one divider is formed to protrude from the unit body toward the storage space in which an upper surface formed inside the storage container is opened, and wherein the holder is formed to protrude upward from the unit body.

The holder may includes a holder body protruding from the unit body and a holder holding portion provided at an end of the holder body and configured to prevent stored goods escaping from the holder body.

The divider unit is detachably disposed in the storage container.

The divider unit is formed integrally with the storage container.

The unit body may includes a first support plate facing one surface of the storage container and a second support plate forming an insertion space configured to be inserted into the storage container together with the first support plate and facing the other surface of the storage container.

The storage container may includes a container body forming the storage space and a guide rib protruding from the container body such that the second support plate and the container body are spaced apart from each other by a predetermined distance.

The divider unit is arranged to move along an opening forming part forming an opening opened on the upper side of the storage space, and the guide rib is formed to be long along the movement path of the divider unit so as to guide the movement of the divider unit.

The guide ribs may include a plurality of guide ribs spaced apart from each other by a predetermined distance The main body may includes a storage chamber formed therein, and the refrigerator may includes a door configured to open and close the storage chamber, the door configured to place the storage container on a rear surface thereof and a rotation guide mounted on a rear surface of the door, wherein the storage container is rotatably mounted on the rotation guide.

The storage container may includes a container body forming a container opening opened at an upper portion thereof and an expansion door rotatably formed on the container body and arranged to expand the container opening through rotation.

In accordance with one aspect of the disclosure, a refrigerator may includes a body having a storage chamber formed therein, a door configured to open and close the storage chamber, a rotation guide mounted on a rear surface of the door, a storage container mounted to the rotation guide and rotatably coupled to the rotation guide and a divider unit disposed at one side of the storage container and rotated together with the storage container and wherein the divider unit may includes a unit body mounted on the storage container and a holder protruding from the unit body and configured to hang the stored goods.

The divider unit may includes a divider protruding from the unit body toward the storage space so as to define a storage space formed inside the storage container, and the holder is formed to protrude upward from the unit body.

The holder may includes a plurality of holders spaced apart from each other in the unit body.

The divider unit is detachably disposed in the storage container.

In accordance with one aspect of the disclosure, a refrigerator may includes a body having a storage chamber formed therein, a door configured to open and close the storage chamber, a storage container rotatably provided at the rear surface of the door with respect to the door and a divider unit disposed on one side of the storage container and wherein the divider unit may includes a unit body mounted on the storage container and a holder protruding from the unit body and configured to receive the stored goods.

The divider unit further includes at least one divider protruding from the unit body to partition a storage space formed in the storage container, and the divider unit includes the unit body, the holder, and at least one divider are integrally formed and detachable from the storage container.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
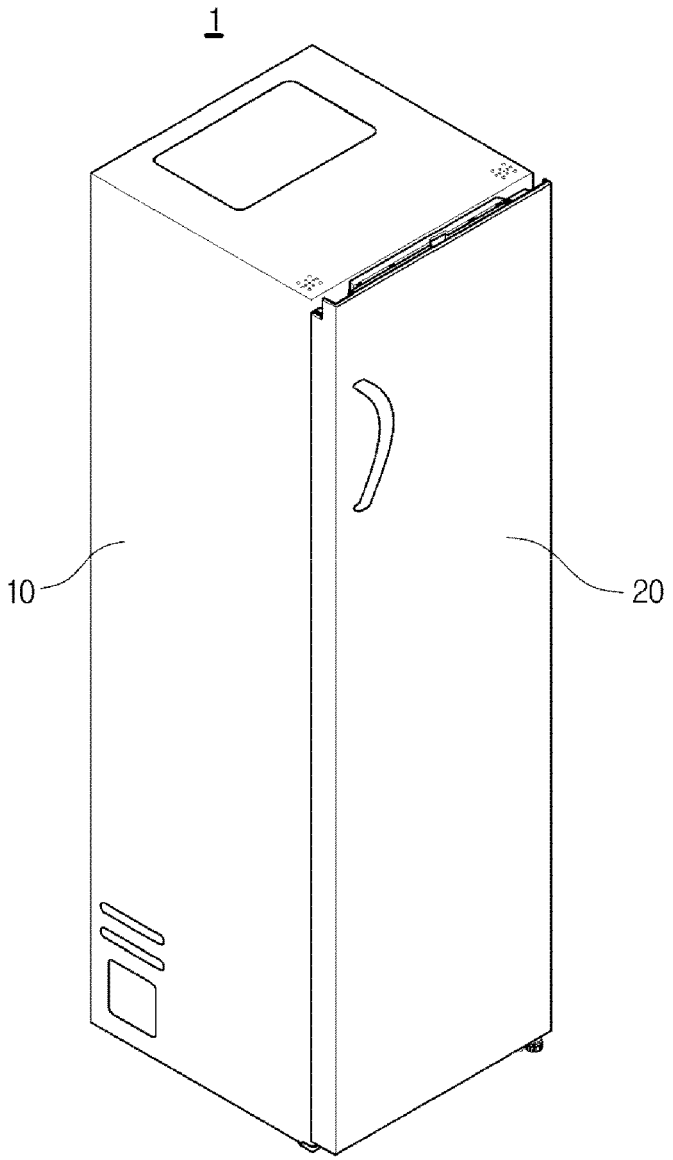
FIG. 1 is a perspective view of a refrigerator according to an embodiment of the present invention.

The embodiments described in this specification and configurations illustrated in drawings are only exemplary embodiments and do not represent the overall technological scope of the invention, and it is to be understood that the invention covers various equivalents, modifications, and substitutions at the time of filing of this application.

Also, throughout the entire specification, the same reference numerals refer to the same components or elements to serve the same function.

Also, the terminology used herein is for the purpose of describing particular embodiments only and is not intended to be limiting of the present invention. Also, as used herein, the singular forms "a," "an," and "the," are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Also, it will be understood that, although the terms including ordinal numbers such as "first," "second," etc. may be used herein to describe various elements, these elements are not limited by these terms. These terms are only used to distinguish one element from another. For example, a second element could be termed a first element without departing from the teachings of the present invention, and similarly a first element could be also termed a second element. The term "and/or" includes any and all combinations of one or more of the associated, listed items.

Hereinafter, embodiments of the present invention will be described more fully with reference to the accompanying drawings.

In the refrigerator of the present embodiment, the refrigerator includes a refrigerator compartment and a freezer compartment. The refrigerator compartment and the freezer compartment, which are arranged in the upper and lower parts, are respectively opened and closed by a single door. However, the shape of the refrigerator is not limited thereto.

Generally, a refrigerator is a household appliance that has a storage room for storing food and a cold supply device for supplying cold air to the storage room, and can store food freshly. The refrigerator can be classified according to the type of the storage room and the door.

The refrigerator includes a top mounted freezer (TMF) refrigerator having a freezing compartment formed on the upper side and a refrigerator compartment formed on the lower side by a horizontal partition and a bottom mounted freezer (BMF) refrigerator having a refrigerator compartment formed on the upper side and a freezing compartment formed on the lower side by a horizontal partition.

Also, the refrigerator includes a SBS (Side By Side) type refrigerator and a FDR (French Door Refrigerator) type refrigerator. In the SBS (Side By Side) type refrigerator, the storage compartment is divided into left and right by the vertical partition, the freezing compartment is formed on one side, and the refrigerating compartment is formed on the other side. In a FDR (French Door Refrigerator) type refrigerator, a storage compartment is divided into upper and lower parts by a horizontal partition, a refrigerating compartment is formed on an upper side, a freezing compartment is formed on a lower side, and an upper compartment is opened and closed by a pair of doors.

In this embodiment, for convenience of explanation, a refrigerator in which the storage compartment is not partitioned is taken as an example. However, it is not limited thereto. The embodiment of the present invention can be applied to a refrigerator of the above-described type.

Figure 2:
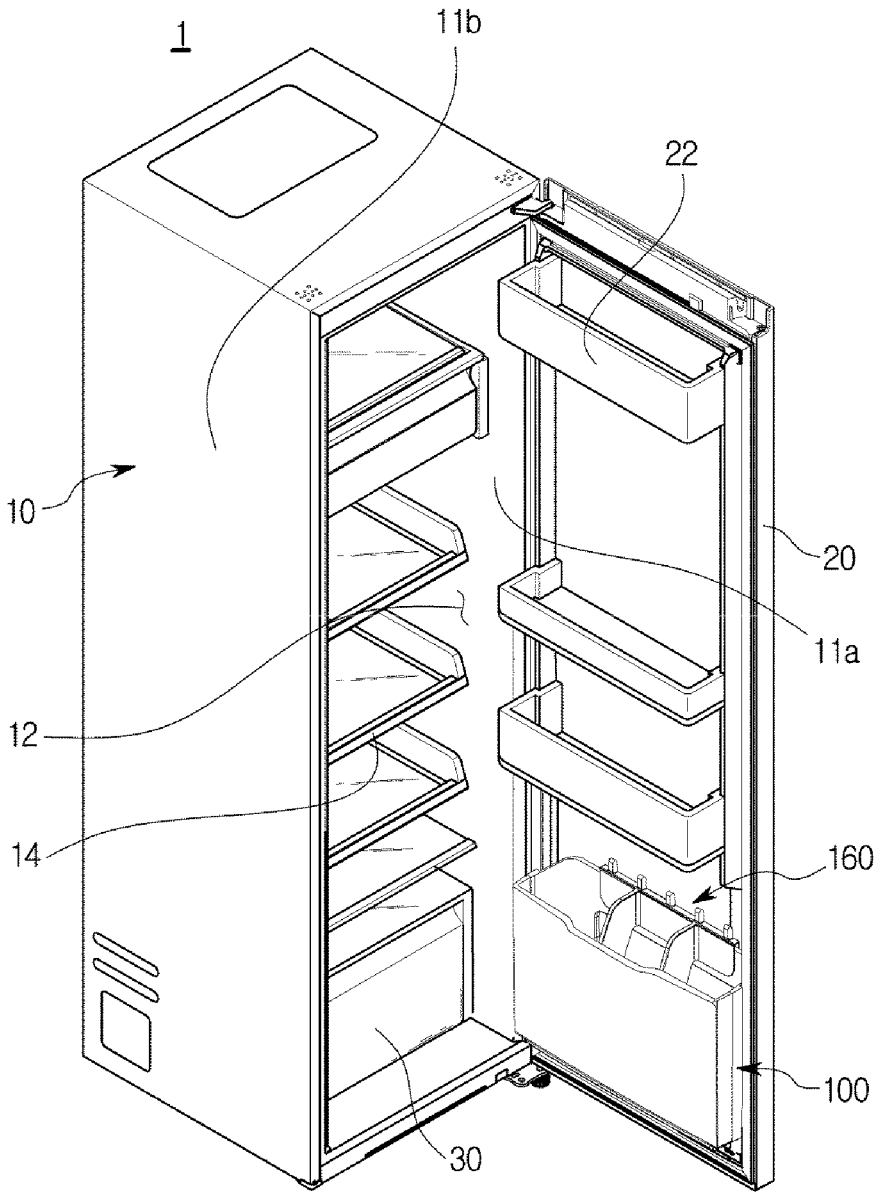
FIG. 2 is a perspective view of a door of a refrigerator according to an embodiment of the present invention when opened.

FIG. 1 is a perspective view of a refrigerator according to an embodiment of the present invention; FIG. 2 is a perspective view of a door of a refrigerator according to an embodiment of the present invention when opened.

The refrigerator 1 includes a main body 10, a storage compartment 12 partitioned into upper and lower parts in the main body 10, and a cooling air supplying apparatus (not shown) for supplying cool air to the storage compartment 12. The main body 10 may include a door 20 for opening and closing the storage chamber 12.

The main body 10 has an inner box 11*a* forming the storage chamber 12, an outer box 11*b* coupled to the outer side of the inner box 11*a* to form an exterior, and a insulating member (not shown) foamed between the inner box 11*a* and the outer box 11*b* for insulating the storage room 12.

The cooling air supplying apparatus can generate cold air using a cooling cycle that compresses, condenses, expands, and evaporates the refrigerant.

The storage compartment 12 can be opened and closed by a door 20 which is rotatably coupled to the main body 10. The shape of the door 20 is not limited, and a sliding door 20 for slidingly opening and closing the door 20 may be applied.

The storage compartment 12 is provided with at least one shelves 14 which can be divided into a plurality of storage compartments 12 and can be arranged at least one storage container 30 capable of storing food or the like.

The door (20) can be provided with door shelves (22) on its backside for storing food.

Figure 3:
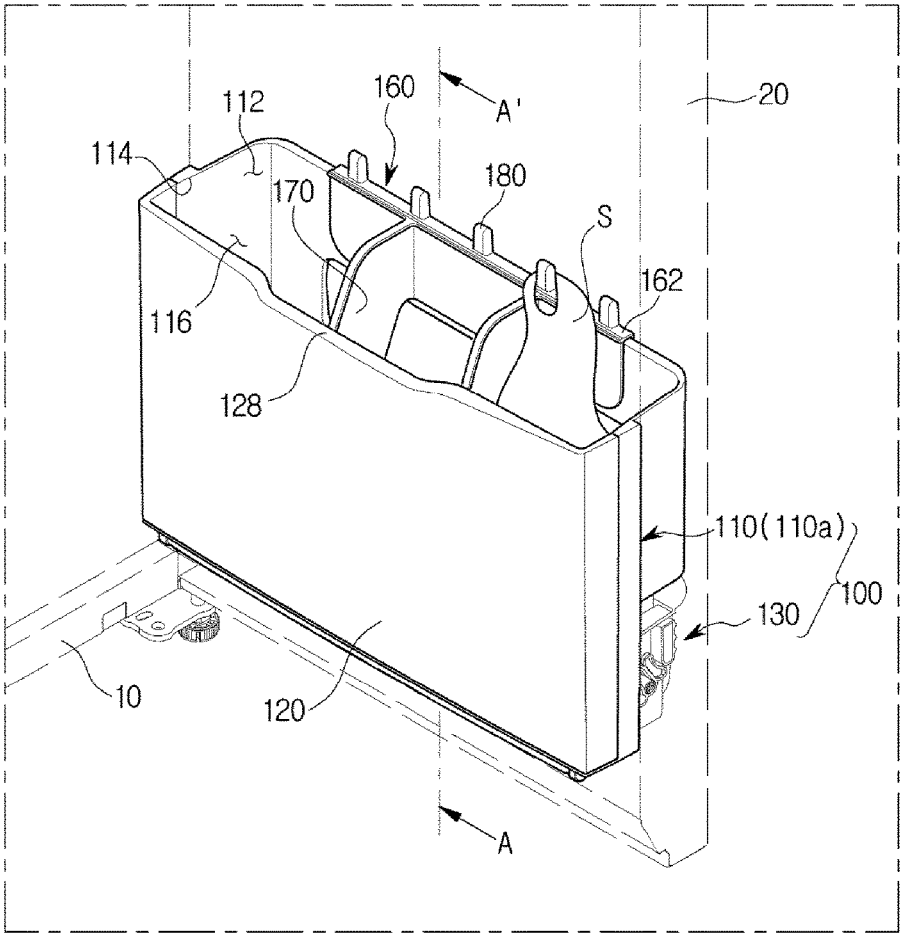
FIG. 3 is a view of an arrangement of a storage container assembly and a divider unit according to one embodiment of the present invention.
Figure 4:
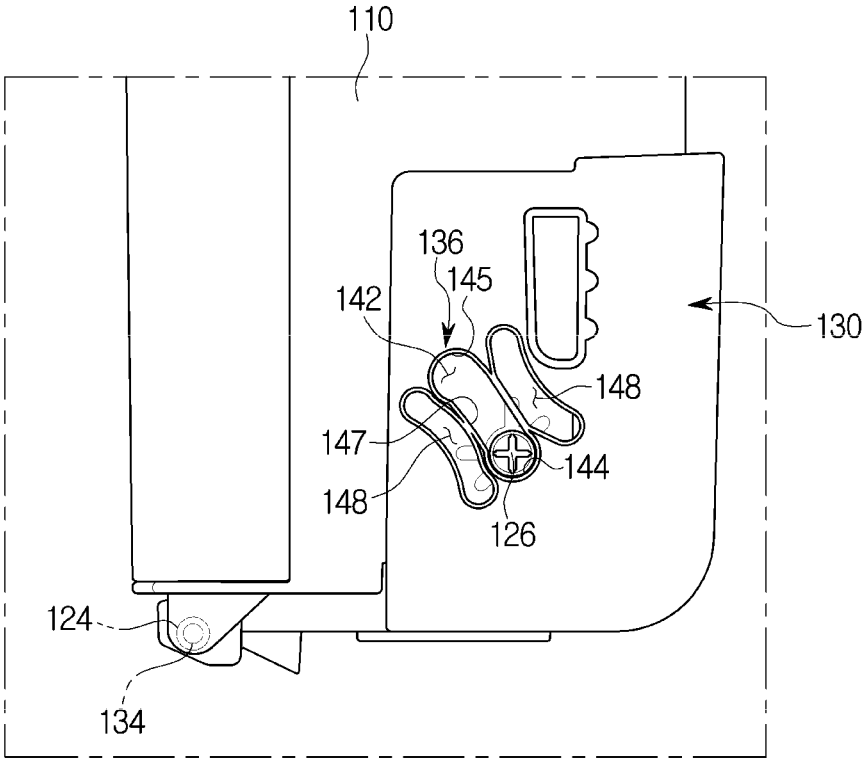
FIG. 4 is a view of the relationship between the position of a storage container assembly and a guide rail in accordance with one embodiment of the present invention.
Figure 5:
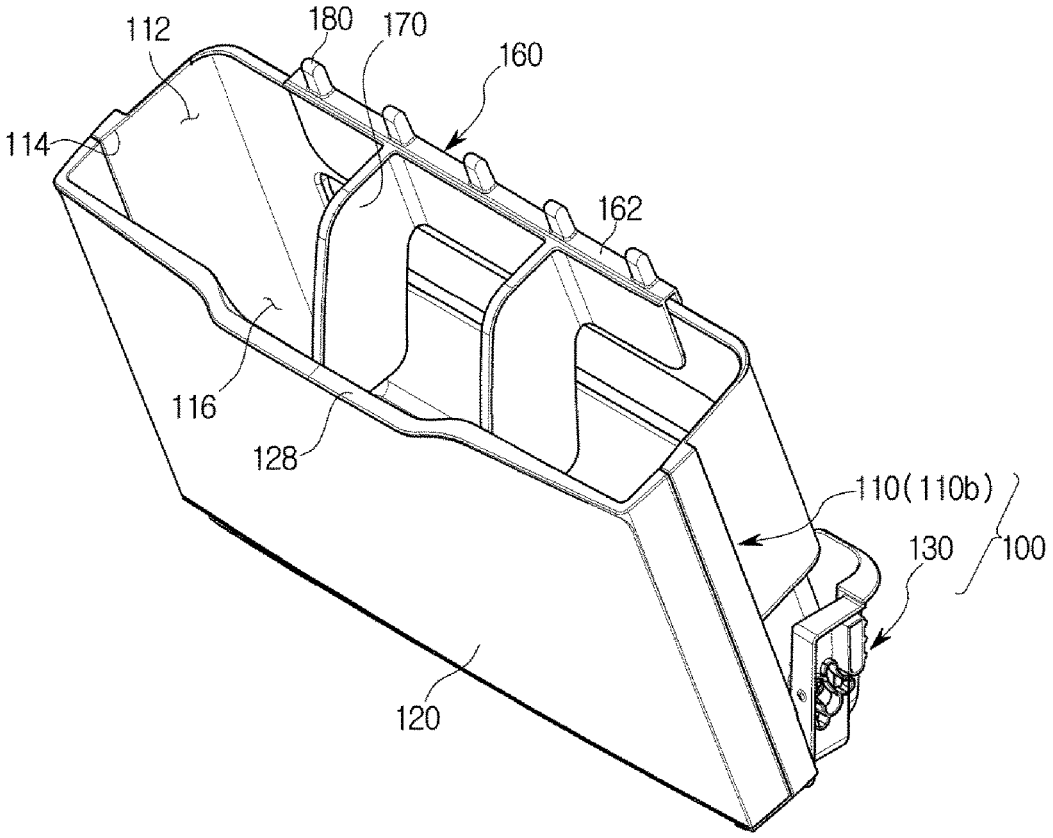
FIG. 5 is a view of operation of a storage container assembly and a divider unit according to one embodiment of the present invention.
Figure 6:
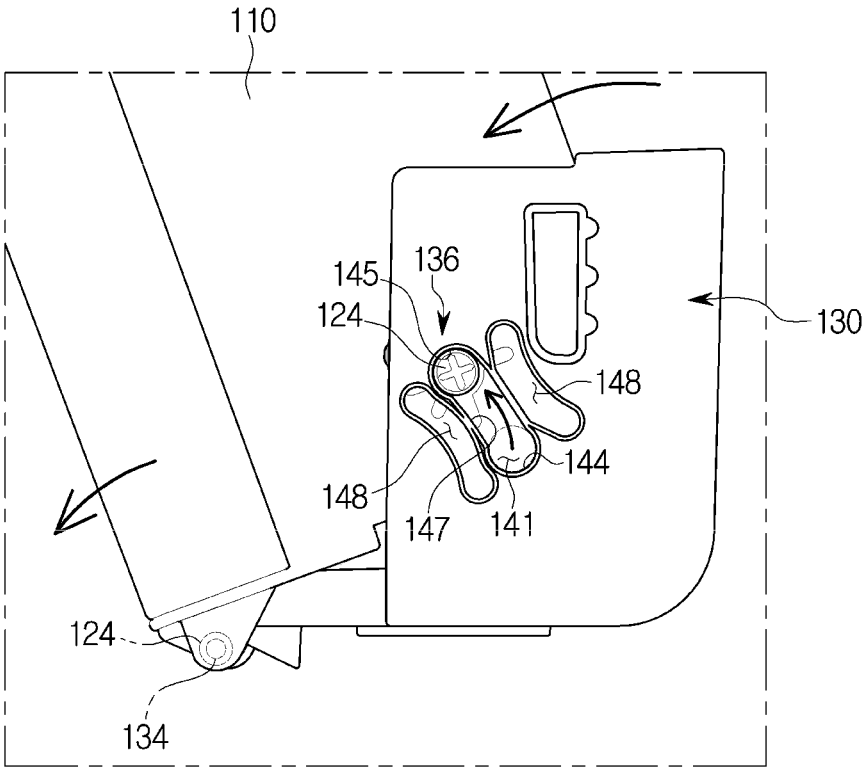
FIG. 6 a view of the relationship between the position of a storage container assembly and a guide rail in accordance with one embodiment of the present invention.
Figure 7:
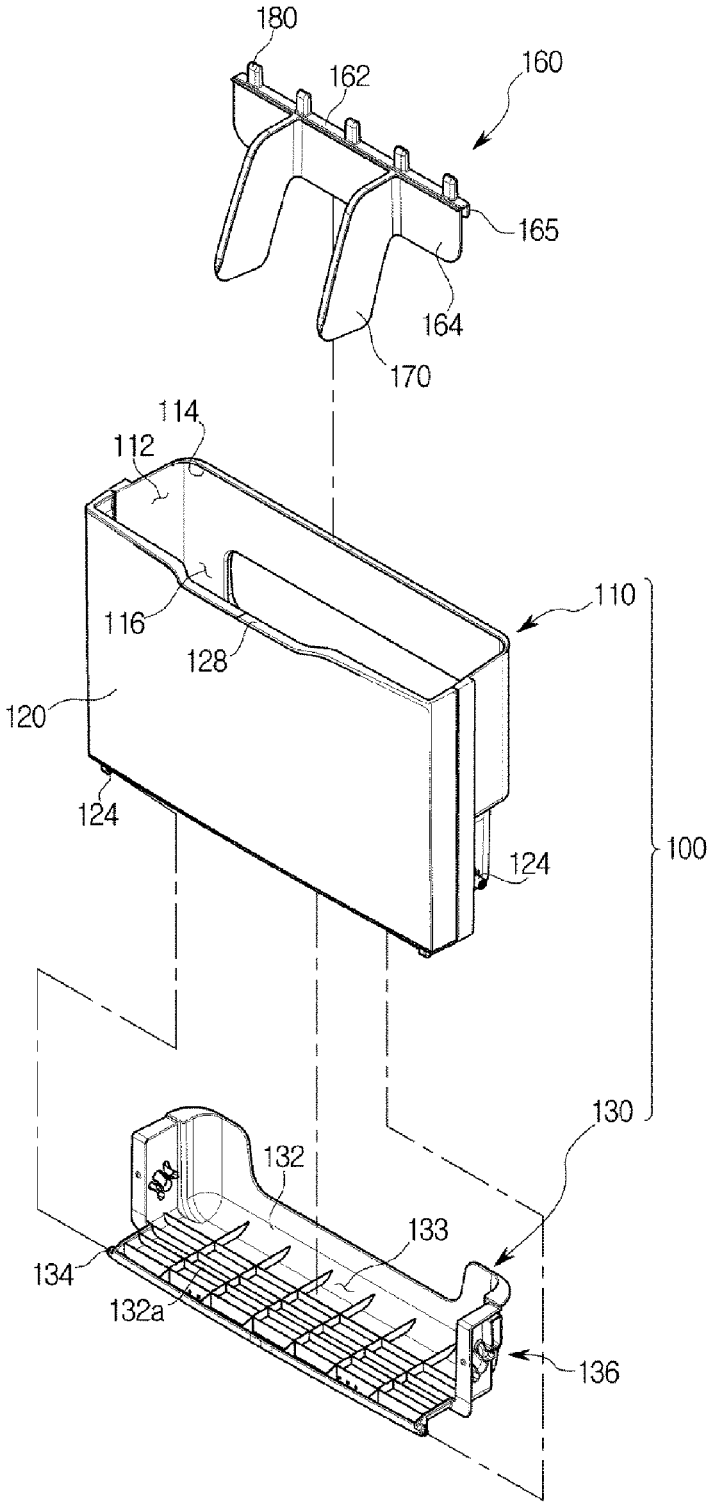
FIG. 7 is an exploded perspective view of a storage container assembly and a divider unit according to one embodiment of the present invention.

FIG. 3 is a view of an arrangement of a storage container assembly and a divider unit according to one embodiment of the present invention, FIG. 4 is a view of the relationship between the position of a storage container assembly and a guide rail in accordance with one embodiment of the present invention, FIG. 5 is a view of operation of a storage container assembly and a divider unit according to one embodiment of the present invention, FIG. 6 a view of the relationship between the position of a storage container assembly and a guide rail in accordance with one embodiment of the present invention, FIG. 7 is an exploded perspective view of a storage container assembly and a divider unit according to one embodiment of the present invention.

The storage container assembly 100 is provided inside the main body 10 to stored contents or stored food. In detail, the storage container 110 may be located in the storage compartment 12 or may be located on the back of the door 20. In this embodiment, the storage container 110 is located on the rear surface of the door 20, but the present invention is not limited.

The storage container assembly 100 may be detachable from the door 20 of the main body 10.

The storage container assembly 100 may include a storage container 110 and a rotating guide 130.

The storage container 110 may be formed in a box shape having an open top. That is, the storage container 110 is provided with a container opening 112 through which stored contents or food can put in and out. The storage container 110 has a storage space 116 in which goods or food can be stored.

The storage container 110 may be provided to be rotatable with respect to the door 20. That is, the container opening 112 of the storage container 110 can be tilted forward for the convenience of the user. The storage container 110 is configured to move between a waiting status 110*a* and a rotating status 110*b* rotated from a waiting status 110*a*. The storage container 110 may include a handle 128 for the user to grasp and manipulate.

The rotating guide 130 can be fixed to the lower portion of the rear surface of the door 20 and is provided to guide the rotation of the storage container 110. In this embodiment, the rotating guide 130 is disposed on the rear surface of the door 20, but may be disposed inside the main body 10, and the arrangement thereof is not limited.

The rotating guide 130 may include a guide body 132 (see FIG. 7), a rotational axis projection 134, and a guide rail 136.

The guide body 132 can stably support at least a part of the storage container 110. The guide body 132 may include a container seating space 133 in which the storage container 110 is seated when the storage container 110 is in the waiting status 110*a*. The guide body 132 may be formed with a reinforce portion 132*a* formed by a plurality of ribs so as to support the weight of the storage container 110 seated in the container seating space 133 inwardly thereof.

A rotating axis protrusion 134 (see FIG. 7) is provided in the guide body 132 and is provided so that the rotation center of the storage container 110 passes. That is, a rotating axis groove 124 corresponding to the rotating axis protrusion 134 is formed in the storage container 110. A rotating axis protrusion 134 is inserted into a rotating axis groove 124, which allows the storage container 110 to rotate about a rotational axis. A pair of rotating axis protrusions 134 may be provided and each may be positioned on either side of the guide body 132. Correspondingly, a pair of rotating axis grooves 124 may also be provided, each of which may be positioned on either side of the storage container 110. Of course, a rotating axis protrusion 134 may be formed in the storage container 110, and a rotating axis groove 124 may be formed in the rotating guide 130.

The guide rail 136 is provided to guide the rotation of the storage container 110. A guide protrusion 126 is provided in the storage container 110 and a guide protrusion 126 is provided to be movable along the guide rail 136. That is, when the storage container 110 rotates about the rotation axis, the guide rail 136 is provided to guide movement of the storage container 110. A pair of guide rails 136 may be provided on the side of the storage container 110.

The guide rail 136 may include first and second points 141 and 142. The first point 141 is the point where the guide protrusion 126 of the storage container 110 is located when the storage container 110 is in the waiting status 110*a*. The second point 142 is the point where the guide protrusion 126 of the storage container 110 is located when the storage container 110 is rotating and is in the rotating status 110*b*.

The guide rail 136 may include first and second stoppers 144 and 145 that form part of the first and second points 141 and 142. The first and second stoppers 144 and 145 are provided to form first and second points 141 and 142 respectively and are provided on the movement path of the guide protrusion 126. The first and second stoppers 144 and 145 may restrict the guide protrusion 126 from moving further than the first and second points 141 and 142.

The guide rail 136 may include a moving rail 147. The moving rail 147 is provided between the first and second points 141 and 142 and forms a rail in which the guide protrusion 126 moves between the first and second points 141 and 142.

The moving rail 147 may be formed to be smaller than the width formed by the first and second points 141 and 142. That is, the width formed by the moving rail 147 may be smaller than the diameter of the guide protrusion 126. In this configuration, when the guide protrusion 126 passes the moving rail 147, the moving rail 147 is elastically widened so that the guide protrusion 126 can elastically move the moving rail 147. The guide rails 147 are formed to be smaller than the widths formed by the first and second points 141 and 142 so that the guide protrusion 126 can not move arbitrarily and can be stably placed.

Figure 13:
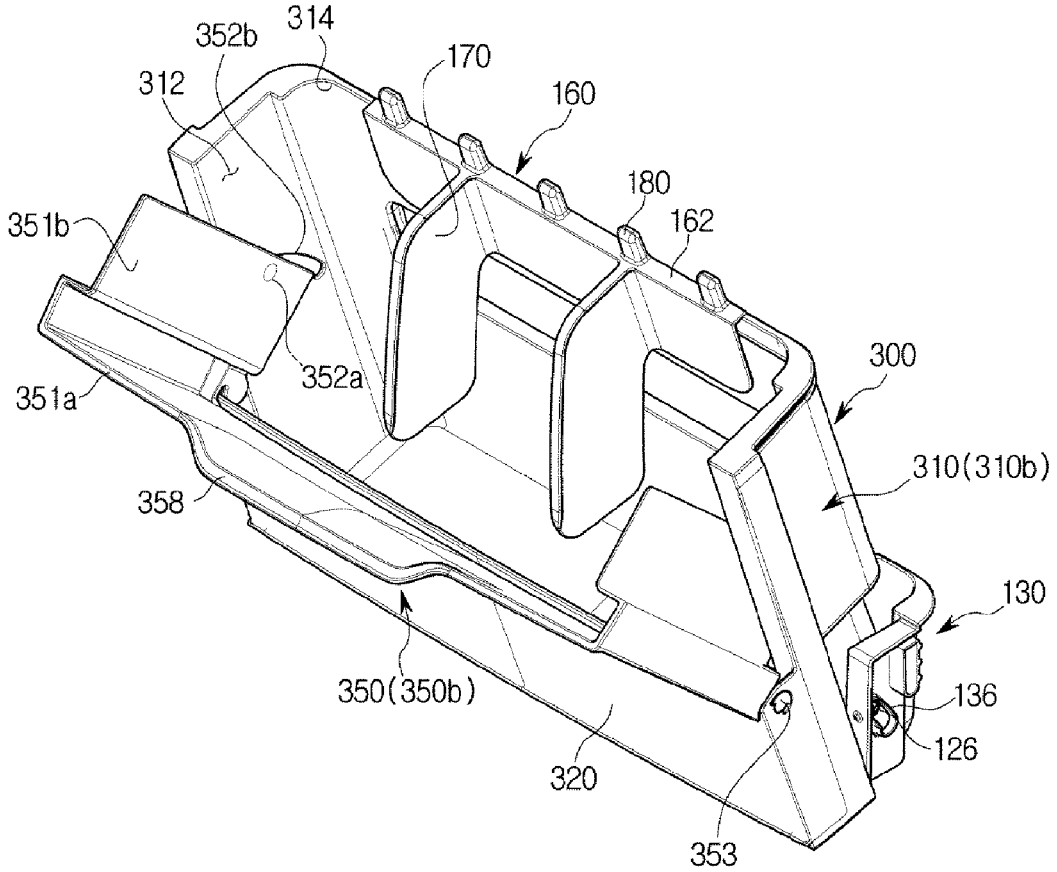

The guide rail 136 may further include an auxiliary space 148. The auxiliary space 148 can form a space through which the width of the moving rail can expand when the guide protrusion 126 passes the moving rail 147. The pair of auxiliary spaces 148 may be formed on one side and the other side of the moving rail 147, respectively. However, the present invention is not limited thereto, and the auxiliary space 148 may be provided only on one side of the moving rail 147 as shown in FIG. 13.

Figure 8:
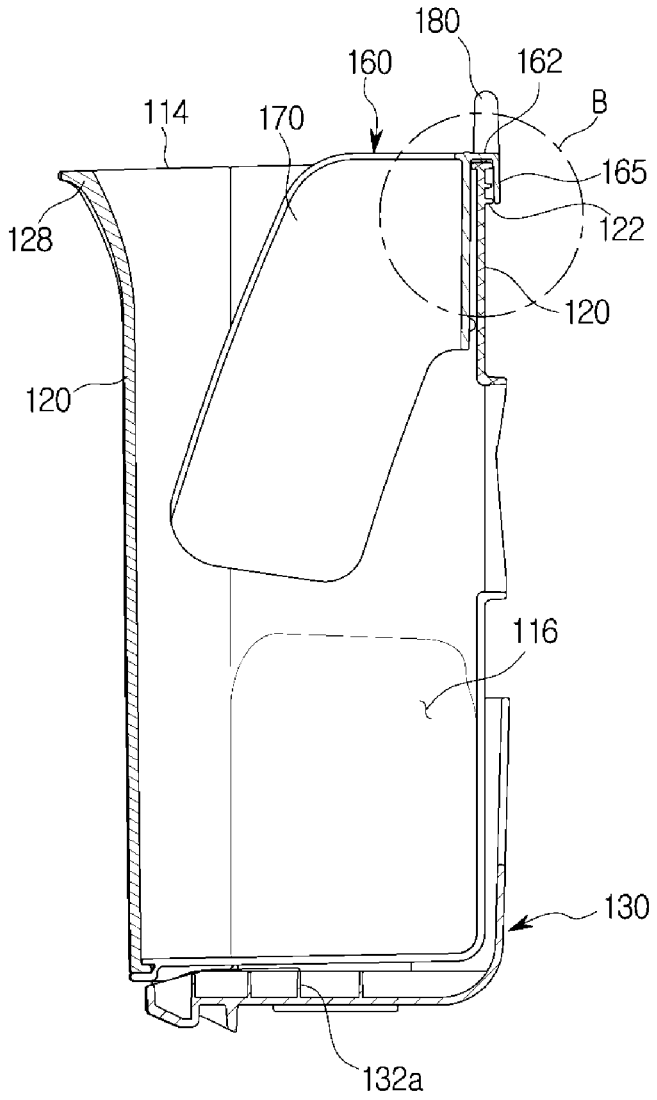
FIG. 8 is a cross-sectional view taken along the line A-A' in FIG. 3.
Figure 9:
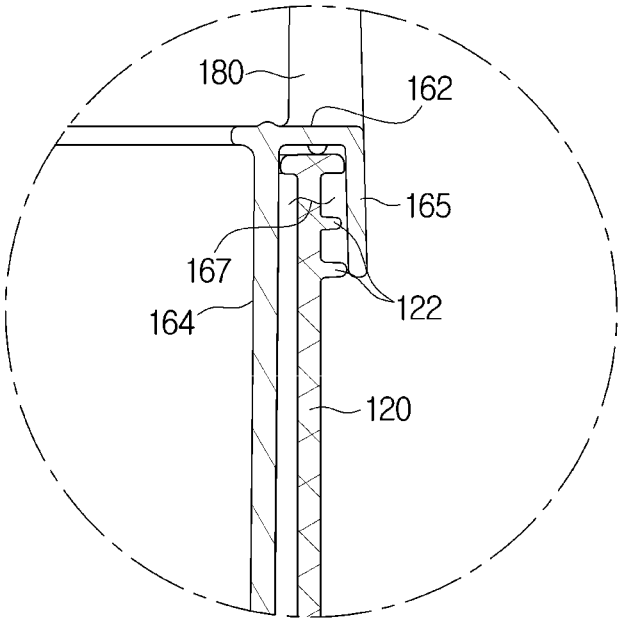
FIG. 9 is an enlarged view of a portion B of FIG. 8.

FIG. 8 is a cross-sectional view taken along the line A-A' in FIG. 3, FIG. 9 is an enlarged view of a portion B of FIG. 8.

The refrigerator 1 may include a divider unit 160.

The divider unit 160 may be disposed on one side of the storage container 110. The divider unit 160 may be detachably mounted to the storage container 110. The divider unit 160 may partition the storage space 116 of the storage container 110 or may function as a hook.

The divider unit 160 may include a unit body 162, a divider 170, and a holder 180.

The unit body 162 is mounted on one side of the storage container 110. The unit body 162 may include a first supporting plate 164 and a second supporting plate 165. An insertion space 167 (see FIG. 9) may be formed between the first supporting plate 164 and the second supporting plate 165 to insert at least a portion of the storage container 110 therein. That is, The first supporting plate 164 faces the inner surface of one side wall of the storage container 110 and the second supporting plate 165 faces the outer surface of one side wall of the storage container 110. The second supporting plate 165 may be spaced apart from the first supporting plate 164.

The divider unit 160 can be mounted on the storage container 110 by inserting one side wall of the storage container 110 into the insertion space 167 formed between the first and second supporting plates 164 and 165.

The divider 170 protrudes from the unit body 162 toward the storage space 116 and can divide the storage space 116 of the storage container 110. The divider 170 may be formed in the shape of a plate and may also protrude from the unit body 162 toward the storage space 116.

At least one divider 170 may be formed in the unit body 162. When a plurality of divider 170 are formed, the interval between the plurality of divider 170 is not limited. In this embodiment, a pair of divider 170 is fixed to the unit body 162. However, the present invention is not limited thereto, and the divider 170 may be movable to the unit body 162.

The holder 180 may protrude from the unit body 162.

The holder 180 may protrude toward the upper portion of the storage container 110. The holder 180 can hold a handle or a hanging goods such as a plastic bag by hanging it like the storage material S of FIG. 3. A plurality of the holders 180 may be provided and may be spaced apart from each other.

At least a portion of the holder 180 may be formed as a curved surface. At least a part of the holder 180 may be formed in a curved surface so that when the goods is put on the holder 180, the goods is not damaged by friction with the holder 180.

The divider unit 160 may be mounted in the storage container 110. Also, when the storage container 110 rotates about its axis of rotation, the divider unit 160 may rotate as well. With this operation, the user can easily put the storage material into and out of the storage space 116, and also easily hold the storage material in the holder 180.

Figure 10:
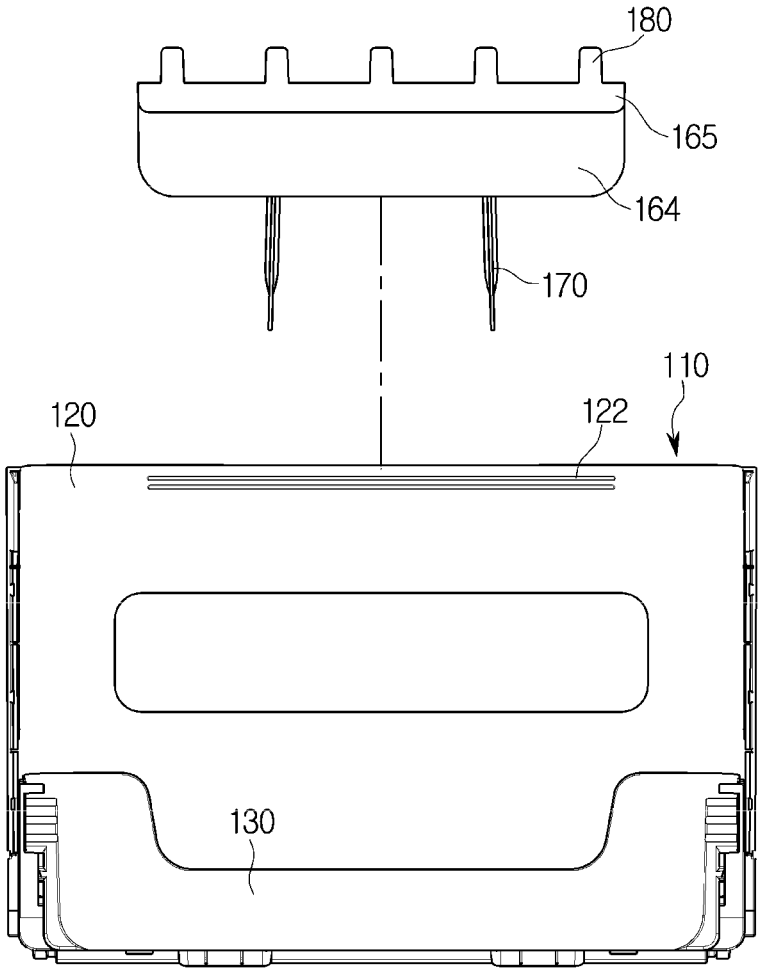
FIG. 10 is a view of the back of a storage container assembly and a divider unit according to one embodiment of the present invention.

FIG. 10 is a view of the back of a storage container assembly and a divider unit according to one embodiment of the present invention.

The refrigerator (1) may include a guide rib (122). The divider unit 160 is mounted on the storage container 110 and can move left and right. That is, the divider unit 160 is provided to be movable along one side wall of the storage container 110. In detail, the divider unit 160 can move along a container opening forming part 114 forming a container opening 112 of the storage container 110. At this time, a guide rib 122 is provided to guide movement of the divider unit 160.

The guide ribs 122 may be in contact with the inner surface of the second supporting plate 165. While the divider unit 160 is moving, the inner surface of the second supporting plate 165 can move along the guide ribs 122.

The guide ribs 122 may be formed long in the direction of movement to guide movement of the divider unit 160. That is, the guide rib 122 may be formed long along one side wall of the storage container 110. The guide ribs 122 may protrude from the unit body 162 as part of the divider unit 160. In this embodiment, the guide rib 122 is part of the storage container 110 and protrudes from one side of the storage container 110.

A plurality of guide ribs 122 may be formed and arranged side by side. The guide rib 122 may be provided on the outer surface of one side wall of the storage container 110 and the guide rib 122 may abut the inner surface of the second supporting plate 165 of the divider unit 160.

Hereinafter, a refrigerator according to another embodiment of the present invention will be described. Descriptions of configurations that are the same as those described above will be omitted.

Figure 11:
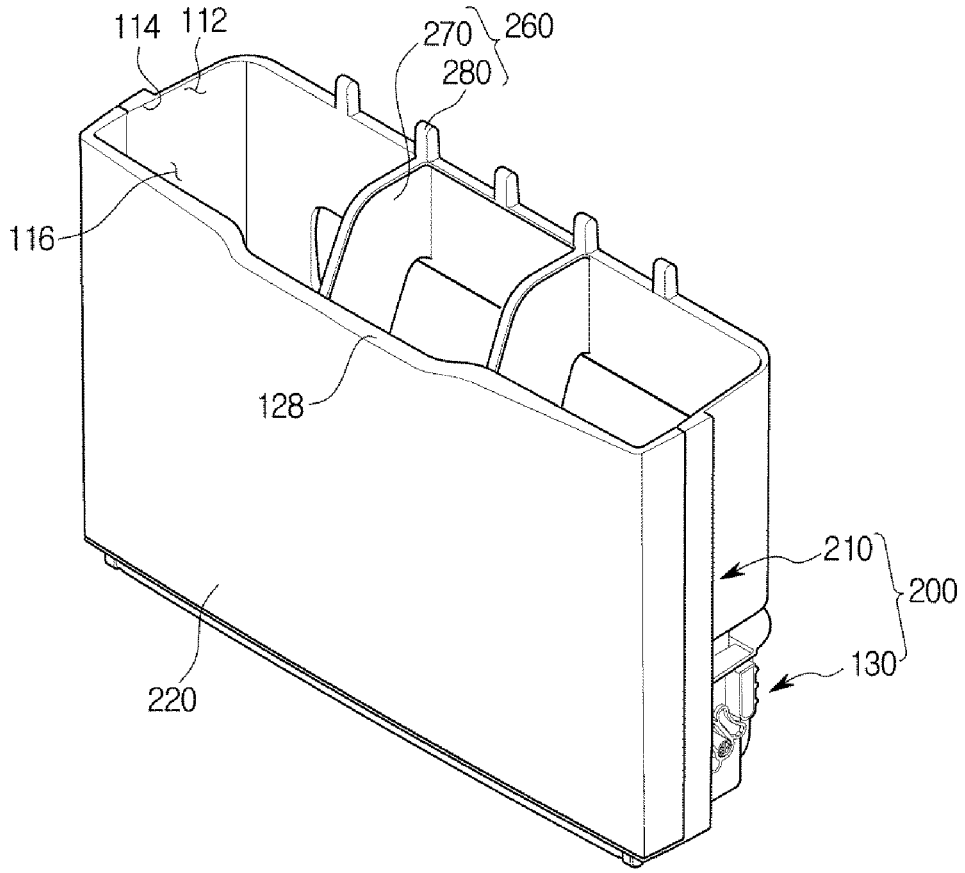
FIG. 11 is a view of a storage container assembly and a divider unit according to another embodiment of the present invention.

FIG. 11 is a view of a storage container assembly and a divider unit according to another embodiment of the present invention.

The storage container assembly 200 may include a storage container 210 and a rotating guide 130.

The storage container 210 may include a divider unit 260.

The divider unit 260 may be disposed on one side of the storage container 110. The divider unit 260 may be removably mounted to the storage container 110. The divider unit 260 may divide the storage space 116 of the storage container 110 or perform a hanging function. That is, the divider unit 260 may include a divider 270 and a holder 280.

The divider unit 260 may be formed integrally with the storage container 110. The divider 270 and the holder 280 may protrude from the container body 220. The divider unit 260 and the storage container 210 may be manufactured together.

Hereinafter, a refrigerator according to another embodiment of the present invention will be described. Descriptions of configurations that are the same as those described above will be omitted.

Figure 12:
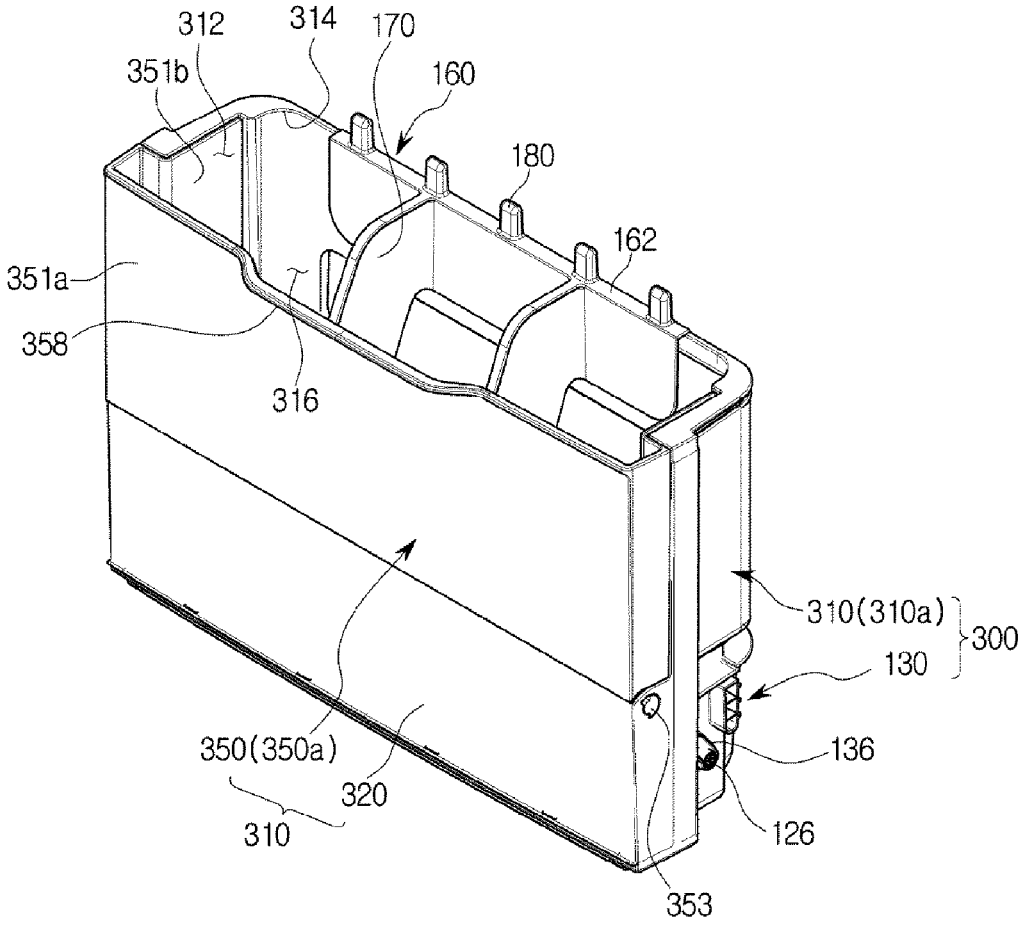
FIGS. 12 and 13 are views of a storage container assembly and a divider unit according to another embodiment of the present invention.
Figure 14:
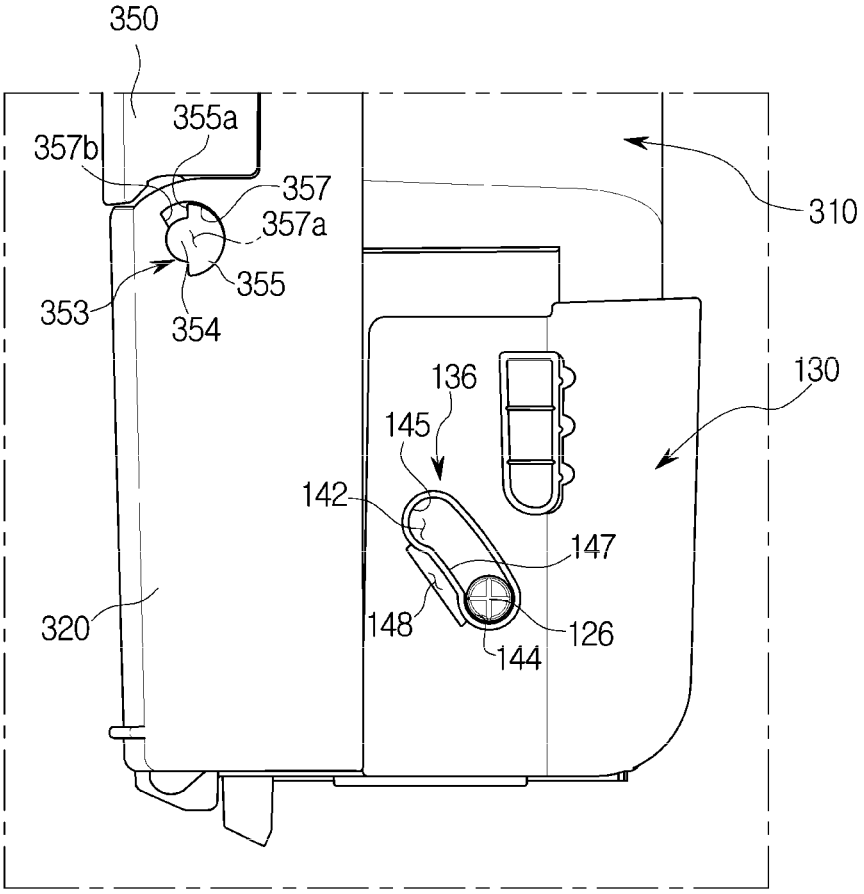
FIG. 14 is a view of a relationship between a storage container assembly and a guide rail in accordance with another embodiment of the present invention.

FIGS. 12 and 13 are views of a storage container assembly and a divider unit according to another embodiment of the present invention, FIG. 14 is a view of a relationship between a storage container assembly and a guide rail in accordance with another embodiment of the present invention.

The storage container assembly 300 may include a storage container 310 and a rotating guide 130.

The rotating guide 130 may be fixed to a lower portion of the rear surface of the door 20 and may guide the rotation of the storage container 310.

The storage container 310 may be formed in a box shape having an open top. That is, the storage container 310 is provided with a container opening 312 through which stored contents or food can put in and out. The storage container 310 has a storage space 316 in which goods or food can be stored.

The storage container 310 may be provided to be rotatable with respect to the door 20. That is, the container opening 312 of the storage container 310 can be tilted forward for the convenience of the user. The storage container 310 is configured to move between a waiting status 310*a* and a rotating status 310*b* rotated from a waiting status 310*a*.

The storage container 310 may include a container body 320 and an expansion door 350 provided to be rotatable with respect to the container body 320. The expansion door 350 is rotatably provided at one side of the container body 320 and is provided to expand the container opening 312. By extending the container opening 312 by the expansion door 350, access to the storage space 316 can be facilitated. The expansion door 350 is provided to form at least a portion of one side wall of the storage container 310.

The expansion door 350 may include a pair of rotation protrusions 353 formed on both sides thereof for rotation of the expansion door 350. The rotation protrusion 353 may be rotatably coupled to a rotation hole 357 formed in the container body 320 so that the expansion door 350 can rotate relative to the container body 320. The expansion door 350 may rotate about a rotation protrusion 353. The expansion door 350 may also move between a waiting status 350*a* that is seated in the container body 320 and a rotating status 350*b* that is rotated from the waiting status 350*a*.

The expansion door 350 may include an expansion door body 351*a* that forms the body of the expansion door 350 and an extension portion 351*b*.

The extension portion 351*b* may be provided to be bent from the expansion door body 351*a* at both sides of the expansion door body 351*a*. In detail, the extension portion 351*b* may be provided to be positioned inside the container body 320 when the expansion door 350 is in the waiting status. The extension portion 351*b* is provided to fill a space that can be formed between the container body 320 and the expansion door body 351*a* when the expansion door 350 is in the rotating status 110*b*. That is, the extension portion 351*b* may be provided to extend from the expansion door body 351*a* so that the storage space 116 is not exposed on.

The expansion door 350 may include a handle 358 for the user to grasp and manipulate.

The rotation protrusion 353 may include a rotating shaft 354 and a hang protrusion 355. The rotating shaft 354 is formed to pass the rotating axis and may be formed in a circular shape.

The hang protrusion 355 may be formed in a fan shape around a rotating shaft 354. The hang protrusion 355 restricts movement of the expansion door 350 to a predetermined section by contacting a pair of hang surfaces 355*a* on both sides of the fan shape to the stopper surface 357*b* described later.

The rotation hole 357 includes a shaft hole 357*a* configured to pass the rotating shaft 354 and a pair of stopper surfaces 357*b* contacting a pair of hang surfaces 355*a* of the hang protrusion 355.

The pair of stopper surfaces 357*b* may be spaced apart from each other by a predetermined angle. The angle formed by the pair of stopper surfaces 357*b* may be formed larger than the angle formed by the pair of hang surfaces 355*a* of the hang protrusion 355. With this configuration, the expansion door 350 can be moved in a predetermined section.

The expansion door 350 may include expansion door protrusions 352*a*.

The expansion door protrusion 352*a* is provided to move along an auxiliary guide rail 352*b* formed in the container body 120. The expansion door protrusion 352*a* moves along the auxiliary guide rail 352*b* when the expansion door 350 rotates the waiting status 350*a* and the rotating status 350*b* about the rotation protrusion 353 as the rotation center. The movement of the expansion door 350 can be guided through the movement of the expansion door protrusion 352*a*. Further, the expansion door protrusion 352*a* moves in a predetermined section of the auxiliary guide rail 352*b*, so that the expansion door 350 can move in a predetermined section.

Hereinafter, a refrigerator according to another embodiment of the present invention will be described. Descriptions of configurations that are the same as those described above will be omitted.

Figure 15:
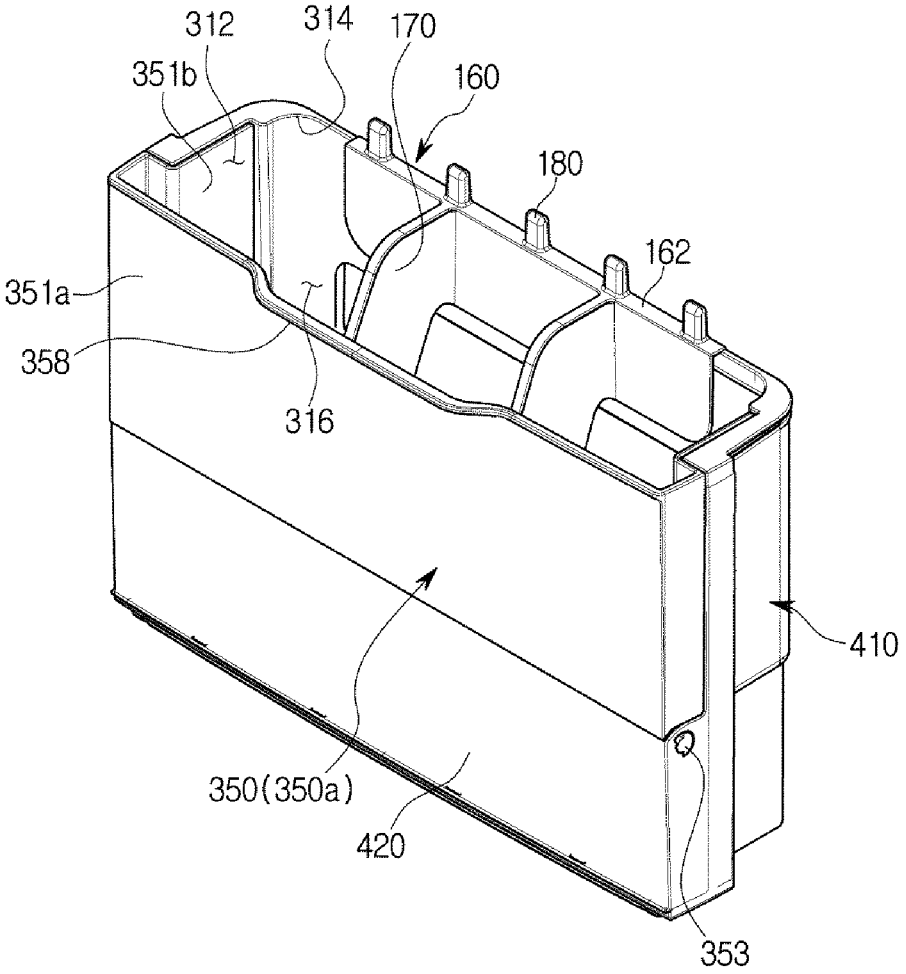
FIG. 15 is a view of a storage container assembly and a divider unit according to another embodiment of the present invention.

FIG. 15 is a view of a storage container assembly and a divider unit according to another embodiment of the present invention.

The storage container 410 may be mounted to the door 20. That is, the storage container 410 may be fixed to the door 20.

The storage container 410 may include a container body 420 and an expansion door 350 provided to be rotatable with respect to the container body 420. The expansion door 350 is rotatably provided at one side of the container body 420 and is provided to expand the container opening 312. By extending the container opening 312 by the expansion door 350, access to the storage space 316 can be facilitated. An expansion door 350 is provided to form at least a portion of one side wall of the storage container 410.

Hereinafter, a refrigerator according to another embodiment of the present invention will be described. Descriptions of configurations that are the same as those described above will be omitted.

Figure 16:
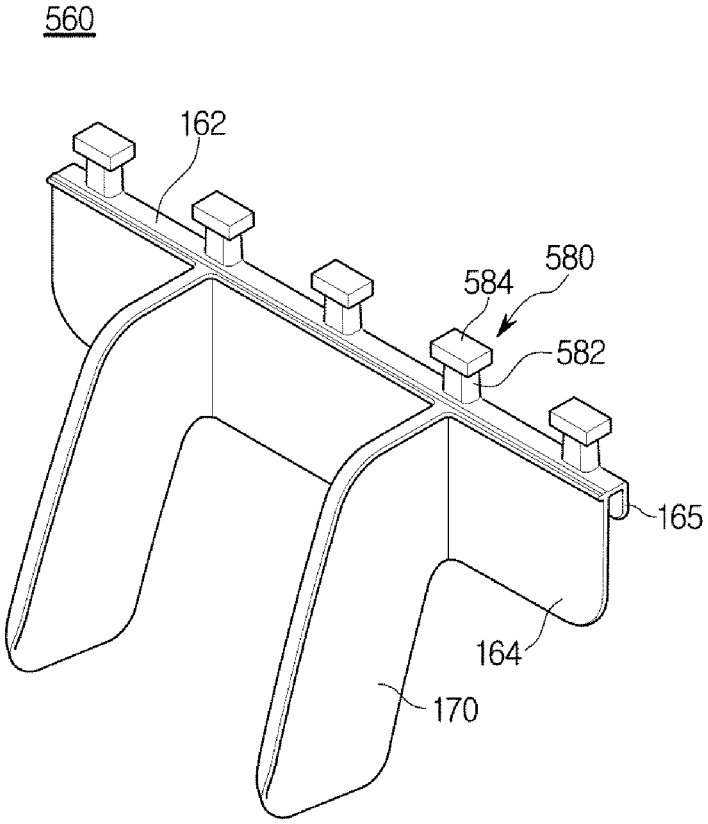
FIG. 16 is a view of a divider unit according to another embodiment of the present invention.

FIG. 16 is a view of a divider unit according to another embodiment of the present invention.

The holder 580 may include a holder body 582 and a hanging portion 584 provided at an end of the holder body 582. The hanging portion 584 may be formed to be thicker than the holder body 582.

This configuration can prevent the storage of the holder 580 from being easily separated from the holder 580 while the storage container 110 moves between the waiting status 110*a* and the rotating status 110*b*.

Hereinafter, a refrigerator according to another embodiment of the present invention will be described. Descriptions of configurations that are the same as those described above will be omitted.

Figure 17:
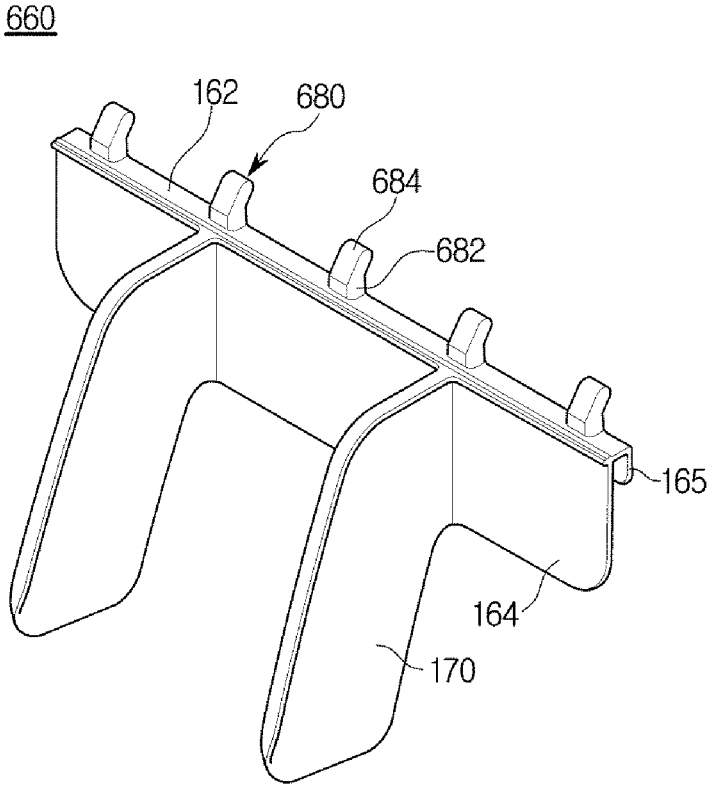
FIG. 17 is a view of a divider unit according to another embodiment of the present invention.

FIG. 17 is a view of a divider unit according to another embodiment of the present invention.

The holder 680 may include a holder body 682 and a hanging portion 684 provided at an end of the holder body 682. The hanging portion 684 may be provided to be inclined at a predetermined angle with respect to the holder body 682.

This configuration can prevent the storage of the holder 180 from being easily separated from the holder 180 while the storage container 110 moves between the waiting status 110*a* and the rotating status 110*b*.

According to an aspect of the present invention, various types of storage materials can be stored in a storage container, thereby improving storage efficiency.

In addition, the storage material in the envelope can be stored in an envelope, thereby improving convenience.

In addition, the storage container can be rotated, so that the user's accessibility to the storage space can be improved.

The foregoing has shown and described specific embodiments. It will be apparent to those skilled in the art that various modifications and variations can be made in the present invention without departing from the spirit and scope of the invention as defined in the appended claims.

The invention claimed is:

1. A refrigerator comprising:

a main body;

a storage container having a storage space therein, the storage container being located inside the main body; and a divider unit mounted on the storage container, wherein the divider unit includes:

a unit body detachably mounted to one side of the storage container;

at least one divider protruding from the unit body to partition the storage space; and a holder protruding from the unit body and adapted to hang a stored product, wherein the unit body includes a first support plate facing an inner surface of the storage container, a second support plate facing an outer surface of the storage container, and an upper portion of the unit body connecting the first support plate and the second support plate to form an insertion space together with the first support plate and the second support plate so that at least a portion of the storage container is inserted into the insertion space, and the holder is formed to protrude upward from the upper portion of the unit body.

2. The refrigerator according to claim 1, wherein the storage container is rotatably provided with respect to the main body, and wherein the divider unit is provided to rotate together with the storage container.

3. The refrigerator according to claim 1, wherein the holder includes a plurality of holders arranged to be spaced apart from each other in the unit body.

4. The refrigerator according to claim 1, wherein at least one surface of the holder is curved.

5. The refrigerator according to claim 1, wherein the at least one divider is formed to protrude from the unit body toward the storage space in which an upper surface formed inside the storage container is opened.

6. The refrigerator according to claim 1, wherein the holder includes:

a holder body protruding from the unit body; and a holder holding portion provided at an end of the holder body and configured to prevent stored goods escaping from the holder body.

7. The refrigerator according to claim 1, wherein the divider unit is detachably disposed in the storage container.

8. The refrigerator according to claim 1, wherein the divider unit is formed integrally with the storage container.

9. The refrigerator according to claim 1, wherein the storage container includes:

a container body forming the storage space; and a guide rib protruding from the container body such that the second support plate and the container body are spaced apart from each other by a predetermined distance.

10. The refrigerator according to claim 9, wherein the divider unit is arranged to move along an opening forming part forming an opening opened on the upper side of the storage space, and the guide rib is formed to be long along a movement path of the divider unit so as to guide the movement of the divider unit.

11. The refrigerator according to claim 9, wherein the guide ribs include a plurality of guide ribs spaced apart from each other by a predetermined distance.

12. The refrigerator according to claim 1, wherein the main body includes a storage chamber formed therein, and the refrigerator includes:

a door configured to open and close the storage chamber, the door configured to place the storage container on a rear surface thereof; and a rotation guide mounted on a rear surface of the door, wherein the storage container is rotatably mounted on the rotation guide.

13. The refrigerator according to claim 1, wherein the storage container includes:

a container body forming a container opening opened at an upper portion thereof; and an expansion door rotatably formed on the container body and arranged to expand the container opening through rotation.

14. A refrigerator comprising:

a body having a storage chamber formed therein;

a door configured to open and close the storage chamber;

a rotation guide mounted on a rear surface of the door;

a storage container mounted to the rotation guide and rotatably coupled to the rotation guide; and a divider unit disposed at one side of the storage container and rotated together with the storage container, wherein the divider unit includes:

a unit body detachably mounted on the storage container; and a holder protruding from the unit body and configured to hang stored goods, wherein the unit body includes a first support plate facing an inner surface of the storage container, a second support plate facing an outer surface of the storage container, and an upper portion of the unit body connecting the first support plate and the second support plate to form an insertion space together with the first support plate and the second support plate so that at least a portion of the storage container is inserted into the insertion space, and the holder is formed to protrude upward from the upper portion of the unit body.

15. The refrigerator according to claim 14, wherein the divider unit includes a divider protruding from the unit body toward the storage space so as to define a storage space formed inside the storage container.

16. The refrigerator according to claim 14, wherein the holder includes a plurality of holders spaced apart from each other in the unit body.

17. The refrigerator according to claim 14, wherein the divider unit is detachably disposed in the storage container.

18. A refrigerator comprising:

a body having a storage chamber formed therein;

a door configured to open and close the storage chamber;

a storage container rotatably provided at a rear surface of the door with respect to the door; and a divider unit disposed on one side of the storage container, wherein the divider unit includes:

a unit body detachably mounted on one side of the storage container; and a holder protruding from the unit body and configured to receive stored goods, wherein the unit body includes a first support plate facing an inner surface of the storage container, a second support plate facing an outer surface of the storage container, and an upper portion of the unit body connecting the first support plate and the second support plate to form an insertion space together with the first support plate and the second support plate so that at least a portion of the storage container is inserted into the insertion space, and the holder is formed to protrude upward from the upper portion of the unit body.

19. The refrigerator according to claim 18, wherein the divider unit further includes at least one divider protruding from the unit body to partition a storage space formed in the storage container, and the divider unit is integrally formed with the unit body, the holder, and at least one divider, and is detachable from the storage container.

* * * * *